US010935018B2

(12) United States Patent
De Andrade et al.

(10) Patent No.: US 10,935,018 B2
(45) Date of Patent: Mar. 2, 2021

(54) SYSTEM FOR CONNECTING REFRIGERANT FLUID DISCHARGE TUBES TO CYLINDER CAPS OF HERMETIC COMPRESSORS AND PROCESS THEREOF

(71) Applicant: EMBRACO INDÚSTRIA DE COMPRESSORES E SOLUÇÕES EM REFRIGERAÇÃO LTDA., Joinville (BR)

(72) Inventors: Daniel Lacerda De Andrade, Joinville (BR); Gerson Araujo, Joinville (BR); Guilherme Espindola, Joinville (BR); Adinor Dominoni, Jr., Joinville (BR)

(73) Assignee: EMBRACO—INDÚSTRIA DE COMPRESSORES E SOLUÇÕES EM REFRIGERAÇÃO LTDA., Joinville (BR)

( * ) Notice: Subject to any disclaimer, the term of this patent is extended or adjusted under 35 U.S.C. 154(b) by 66 days.

(21) Appl. No.: 15/621,012

(22) Filed: Jun. 13, 2017

(65) Prior Publication Data

US 2017/0356434 A1 Dec. 14, 2017

(30) Foreign Application Priority Data

Jun. 14, 2016 (BR) ..... 10 2016 013772

(51) Int. Cl.
*F04B 39/14* (2006.01)
*F04B 39/12* (2006.01)
(Continued)

(52) U.S. Cl.
CPC ..... *F04B 39/123* (2013.01); *F04B 39/125* (2013.01); *F04B 39/126* (2013.01);
(Continued)

(58) Field of Classification Search
CPC ..... F04B 39/14; F04B 39/123; F04B 39/125; F16L 13/103
See application file for complete search history.

(56) References Cited

U.S. PATENT DOCUMENTS 5,158,514 A * 10/1992 Braga ..... F04B 39/121 417/310
2003/0038476 A1* 2/2003 Galle, Jr. ..... F16L 15/003 285/92

(Continued)

FOREIGN PATENT DOCUMENTS

DE 948461 C * 8/1956
DE 4127775 A1 * 2/1993

(Continued)

*Primary Examiner* — David Bochna
*Assistant Examiner* — James A Linford
(74) *Attorney, Agent, or Firm* — Foley & Lardner LLP

(57) ABSTRACT

The present invention belongs to the technological field of compressors for cooling systems and, according to a preferred embodiment of the present invention, the connecting device a substantially cylindrical or tubular body provided, at one of its ends, with an outer perimetral projection and co-operative with a duct or channel of a cylinder cap, wherein, preferably, the device will be produced with steel, aluminum alloy, or other metal alloy with similar structural and thermal properties, mainly due to the stresses it may suffer during use and to be able to absorb the tolerance variations and to have a resilience capable of providing resistance at the time the connection undergoes mechanical stresses of performance—especially torsion.

4 Claims, 3 Drawing Sheets

(SECTION AA)

(51) Int. Cl.

| | |
|---|---|
| ***F25B 31/00*** | (2006.01) |
| *F04B 39/00* | (2006.01) |
| *F04B 39/02* | (2006.01) |
| *F04C 29/06* | (2006.01) |

(52) U.S. Cl.
CPC ..... *F04B 39/14* (2013.01); *F25B 31/00* (2013.01); *F04B 39/0055* (2013.01); *F04B 39/023* (2013.01); *F04B 2205/09* (2013.01); *F04C 29/068* (2013.01)

(56) References Cited

U.S. PATENT DOCUMENTS

| | | | | |
|---|---|---|---|---|
| 2004/0052661 | A1 | 3/2004 | Seo | |
| 2011/0233925 | A1* | 9/2011 | Pina | F16L 15/04 285/333 |
| 2013/0181436 | A1* | 7/2013 | McPherson | F16L 13/103 285/22 |

FOREIGN PATENT DOCUMENTS

| | | | |
|---|---|---|---|
| FR | 1476758 | A * | 4/1967 |
| WO | WO-2015164704 | A1 * | 10/2015 |

* cited by examiner (STATE OF THE ART)

(SECTION AA)

SYSTEM FOR CONNECTING REFRIGERANT FLUID DISCHARGE TUBES TO CYLINDER CAPS OF HERMETIC COMPRESSORS AND PROCESS THEREOF

FIELD OF THE INVENTION

The present invention relates to an improvement introduced in a system for connecting discharge tubes of hermetic compressors, more precisely to allow coupling between the refrigerant gas discharge tube and the cylinder cap of the compressor in a simpler, more practical, more efficient and more economical way than that achieved with the use of the like known in the present state of the art.

BACKGROUND OF THE INVENTION

As is well known, compressors are apparatus widely used in cooling systems, more precisely to promote continuous circulation of the refrigerant fluid in a cycle. For this purpose they comprise, inside a hermetically sealed housing, a mechanical assemblage comprising a block containing a cylindrical cavity in which a piston moves, wherein said cylinder is closed by a cap in which is located a discharge valve through which the refrigerant fluid with high pressure due to the actuation of the piston is expelled to continue its course in the cooling cycle.

In the known conventional configurations, the compression cylinder cap is fixed with the aid of four screws, wherein one of said screws has a different embodiment to act as a connecting element between the cap and the discharge tube—in other words, the refrigerant gas passes through said screw to enter the discharge tube. However, the development in said technology has reached a point at which the screws for coupling the cap to the block are no longer needed, which led to the search for solutions to enable a new form of coupling the discharge tube to the cylinder cap.

A solution for coupling discharge tube was proposed in document US 2004/0052661, as shown in the attached FIG. 1, wherein a connecting member (120) must be coupled to the connecting hole (101) of a cylinder block (100) to subsequently receive in its central cavity the discharge tube (110) which, by the action of a compression member (130), will promote the expansion of the connecting member (120) to conclude the coupling between the components. In addition, the inner region of the connecting hole (101) of the block (100) is threaded to cause deformation of the compression member (130) during coupling of the discharge tube (110). However, it occurs that the thread form in the inner surface of the hole (101) of the block (100) ends up demanding more complex production processes which significantly increase the final cost of the piece. Furthermore, the sealing of said connection—which is made only by interference, without the use of any additional sealing means—is totally dependent on the mechanical changes of said components, since it is only promoted by the expansion of the connecting member (120) as a consequence of the insertion of the discharge tube (110); however, it is known that dimensional variations occur during the processes for producing the components, so that there are risks that incidental variations may interfere with the proper sealing of the connection—which could compromise the entire operation of the cooling system and cause various inconveniences. It should be noted, moreover, that the solution of the document in question is intended to fix the discharge tube to the compressor block, not to the cap thereof—where it is most suitable.

In view of the drawbacks above, it is noted that the present state of the art lacks practical, efficient and economical solutions to promote coupling between a discharge tube and the cylinder cap of a hermetic compressor.

OBJECTIVES OF THE INVENTION

Therefore, the present invention is basically aimed to solve the technical problem of the difficulty and complexity of coupling refrigerant gas discharge tubes to the cap of a compression cylinder block.

Accordingly, it is one of the main objectives of the present invention to disclose an improvement introduced in a system for connecting refrigerant fluid discharge tubes to cylinder caps of hermetic compressors which are fixed to the respective block without the use of screws.

It is also an objective of the present invention to provide a system for connecting discharge tubes which do not use cap fixing elements (pins, screws or the like) as means of passage or interaction with the refrigerant fluid circulating through the system.

It is a further objective of the present invention to provide a system for connecting discharge tubes which aids in reducing the loss of load which, in similar known systems, was a consequence of the obstruction of the gas path by the screws or cap fixing elements, wherein the minimization of said loss of load results in a significant increase in efficiency of the compressor.

Another objective of the invention is to disclose a system for connecting tubes comprising elements exclusively intended to promote the appropriate sealing of the connection in order to ensure a complete tightness of the cooling system, regardless of the dimensional variations which the constituent components thereof may present.

Another objective of the present invention is to provide a system for connecting tubes which allows the assembly by interference between said connecting device and the discharge tube.

The present invention also aims to disclose a process of performing connection between the discharge tube and the compression cylinder cap, which provides optimal sealing conditions in a practical, quick and economical way.

SUMMARY OF THE INVENTION

The abovementioned objectives are achieved by an improvement introduced in a system for connecting refrigerant fluid discharge tubes to cylinder caps of hermetic compressors, more precisely to promote coupling between at least one discharge tube (1) in a cylinder cap (2) of a compressor, wherein in accordance with a preferred embodiment of the invention said improvement comprises: at least one connecting device (10) comprising a tubular body (11) provided, at one of its ends, with a perimetral flap (12) co-operative with the discharge tube (1); a cylinder cap (2) comprising at least one channel (21) co-operative with the at least one connecting device (10); and at least one layer of sealing material applied on the two interfaces: connecting device (10) co-operative with the cylinder cap (2), and connecting device (10) co-operative with the discharge tube (1); wherein the end of the discharge tube (1) co-operating with the connecting device (10) has conical form; wherein the co-operation between the discharge tube (1) and the connecting device (10) is made by interference; wherein the entire surface of the discharge tube (1) co-operating with the connecting device (10) is rolling; wherein the co-operation between the connecting device (10) and the channel (21) of the cylinder cap (2) is made by interference; and wherein the connecting device (10) is produced with at least one of the following materials: steel, aluminum alloy, or metal alloy containing steel or aluminum.

Preferably, the sealing material comprises an adhesive material.

The abovementioned objectives are also achieved by a process of performing connection of refrigerant fluid discharge tubes to cylinder caps of hermetic compressors, characterized by the fact that it employs at least one connecting device, according to any one of claims 1 to X, and it comprises the following steps:

(200) performing the rolling at the end of the discharge tube (1);

(210) pre-assembly step: coupling, by interference, of the discharge tube (1) to the connecting device (10);

(220) positioning of the pre-assembled assemblage of discharge tube (1) with connecting device (10) through the channel (21) of the cylinder cap (2) until the discharge tube (1) reaches the stop (22) existing inside the cylinder cap (2);

(230) coupling the connecting device (10) to the channel (21) of the cylinder cap (2) by the pressure put by an apparatus adapted to the perimetral flap (12) of the connecting device (10);

(240) applying at least one layer of sealing material on the two interfaces: connecting device (10) co-operative with the cylinder cap (2), and connecting device (10) co-operative with the discharge tube (1);

(250) applying ultraviolet light, or the like, to promote bleaching of the sealing material.

According to a preferred embodiment of the invention, said tube (1) forms a male-type coupling element for co-operating with a female-type connecting device (10).

BRIEF DESCRIPTION OF THE DRAWINGS

The present invention will be described in detail on the basis of the figures listed below, in which.

DETAILED DESCRIPTION OF THE INVENTION

The subject matter of the present invention will be more fully described and explained on the basis of the accompanying drawings, which are of a merely exemplary and non-limiting character, since adaptations and modifications may be performed without, thereby, escaping from the claimed scope of protection.

Figure 1:
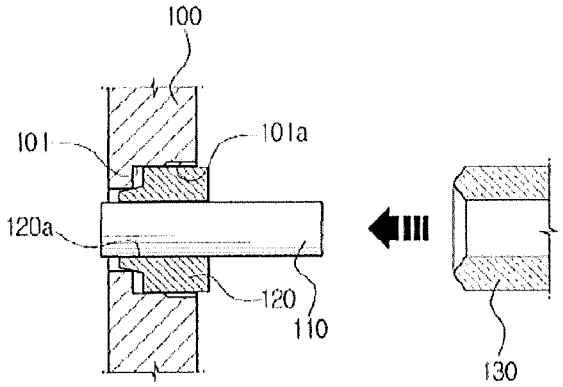
FIG. 1 shows a schematic view of a system for connecting discharge tube of the present state of the art.
Figure 2:
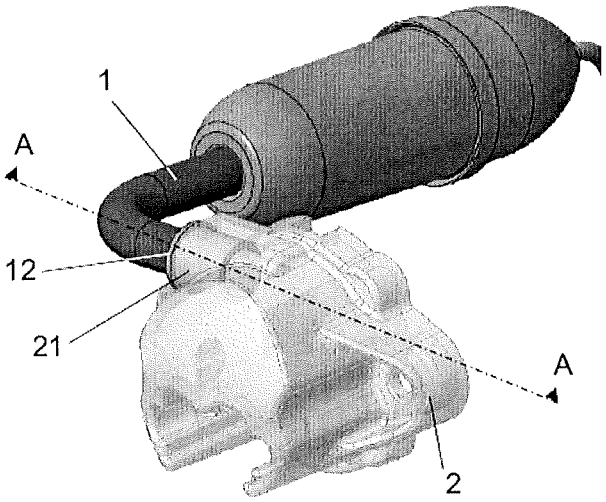
FIG. 2 shows a perspective view of a compression cylinder cap to which a discharge tube was fixed with the aid of the connecting device and process, according to a preferred embodiment of the present invention.
Figure 3:
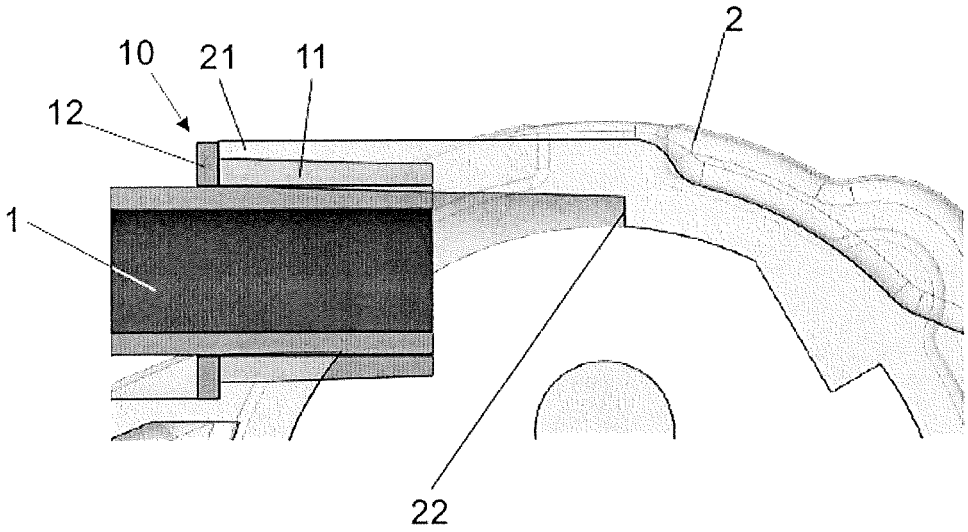
FIG. 3 shows a sectional view of a compression cylinder cap suitably coupled to the discharge tube, allowing a detailed view of the position of the connecting device shown herein and its interaction with the other components of the cooling system.
Figure 4:
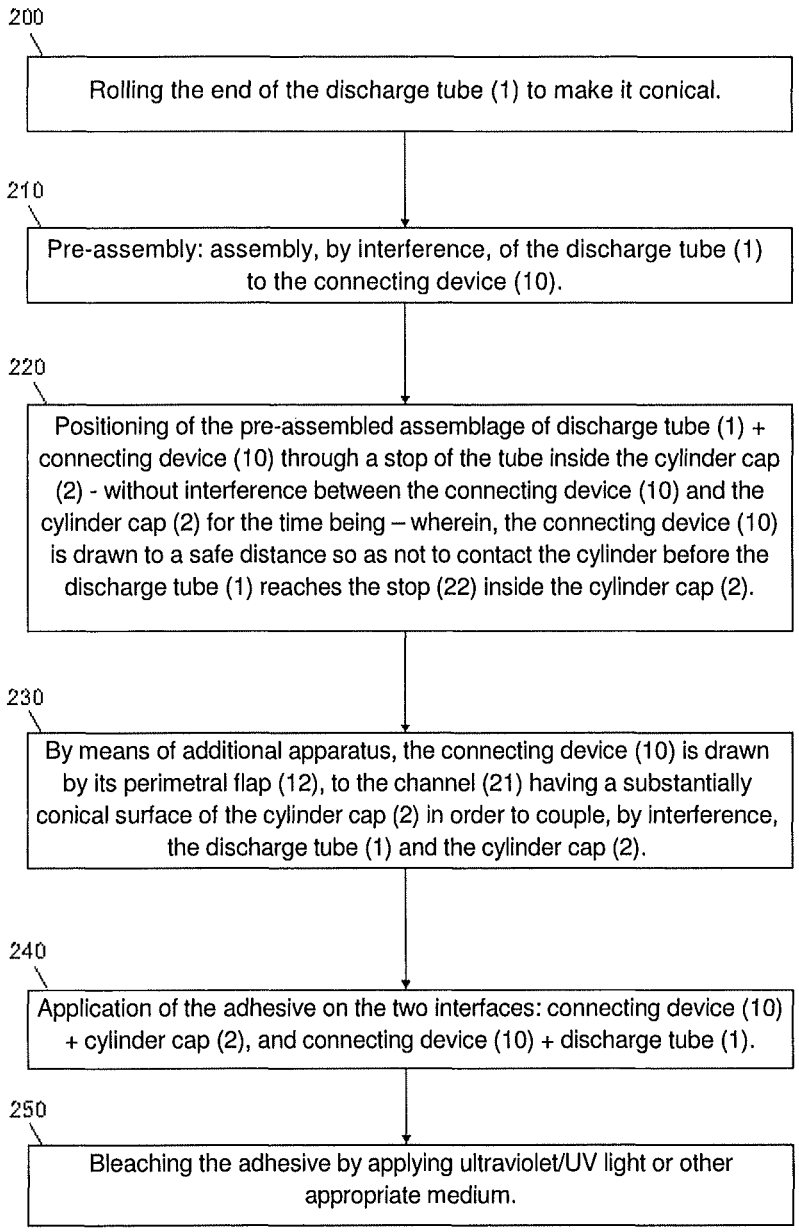
FIG. 4 shows a flow chart illustrating the process of performing the connection of the discharge tube to the compression cylinder cap, a subject matter of the present invention.

The present invention relates to a connecting device (10) which can be best observed by the cross section of the attached FIG. 3, in which it is performed the connection between a discharge tube (1) (produced in copper-covered steel or the like) and a cylinder cap (2) of a hermetic compressor for cooling system.

According to a preferred embodiment of the present invention, the connecting device (10) comprises a substantially cylindrical or tubular body (11) provided, at one of its ends, with a perimeter flap (12) which acts as an auxiliary element for the assembly of said connecting device (10) in the hole, duct or channel (21) of the cylinder cap (2). Preferably, the device (10) will be produced in steel, aluminum alloy or other metal alloy with similar structural and thermal properties, mainly due to the stresses it may suffer during use and to be able to absorb the tolerance variations and to have a resilience capable of providing resistance at the time the connection undergoes mechanical stresses of performance—especially torsion.

It should be clarified that one of the main functions of the connecting device (10) is to absorb the dimensional tolerance of both the discharge tube (1) and the cylinder cap (2) since, as is known for a person skilled in the art, the cap (2) is made in injected material while the discharge tube (1) is metallic, so that it has a significantly large dimensional tolerance field.

The connection between the discharge tube (1) and the cylinder cap (2) requires an initial pre-assembly procedure in which the connecting device (10) is coupled, by interference, to the discharge tube (1), and then the assemblage of connecting device (10)+discharge tube (1) is coupled to the cylinder cap (2). However, since the coupling of said components will also be made by interference at the ambient temperature, it is assumed that the dilatation of each piece will occur in a different way, so that it becomes necessary to use some adhesive means to aid in the sealing of the connection—which is also required due to the fact that the constituent material of said components does not present, per se, sealing characteristics.

In order for the connection proposed herein to be well performed and to have an appropriate efficiency, the end of the discharge tube (1), preferably, must present a certain conicity at its free end to prevent that the interference of the discharge tube (1) in the connecting device (10) causes the machining thereof with consequent generation of chips from its inner surface.

It should be noted that the inner surface of the connecting device (10) which will remain in contact with the tube (1) must be plain and rectilinear, just to eliminate the chance of occurrence of undue deformations which could arise due to the fact that the discharge tube (1) is much more robust and resistant than the material of the connecting device (10)—remembering that, preferably, the depth of insertion of the connecting device (10) in the discharge tube (1) should be controlled. In a preferred, but non-limiting, embodiment of the invention, the discharge tube (1) is introduced in the connecting device (10) so as to exceed the extension thereof—in other words, not only until the end of the rolling, it being pointed out that there will also be a straight rolling in order to compensate the geometric variations on the entire surface of the discharge tube (1) with which the connecting device (10) contacts—wherein, as the pieces are interfering with each other, the connecting device (10) will expand on the tube (1), deforming both pieces and causing a rigid and perfect coupling.

It should be noted that in a pre-assembly step of the system, the discharge tube (1) is introduced in the connecting device (10) on the side where the perimetral flap (12) is located, wherein said connecting device (10) is drawn by a safe length so that there is no contact between the connecting device (10) and the cylinder cap (2) when the discharge tube (1) reaches the stop (22) inside the cylinder cap (2). Once the said pre-assembly is concluded, the discharge tube (1) is then suitably positioned in relation to the stop (22) existing inside the cylinder cap (2)—in other words, until both components touch—and only after said positioning the connecting device (10) is forced, with the aid of additional apparatus, to enter in the channel (21) having a substantially conical inner surface in order to promote the assembly by interference. In this regard, it is important to point out that there is relative movement between the connecting device (10) and the discharge tube (1), in addition to the relative movement between the connecting device (10) and the cylinder cap (2), so that after the initial assembly by interference is consolidated, it is possible to apply a material capable of promoting the sealing of the connection.

It is also important to make it clear that the perimetral flap (12) of the connecting device (10) acts as an auxiliary element for the assembly, since it provides the additional apparatus used in that procedure with a support element to which it is applied the pressure necessary to conclude the coupling between the pieces. Further, the depth of insertion of said connecting device (10) relative to the channel (21) will be controlled by the insertion force which should be applied in accordance with the mechanical strength of the cylinder cap (2).

The sealing of the connection will be made by the application of adhesive material on the two interfaces of the assembly, one of them being the assemblage of connecting device (10)+cylinder cap (2), and the other interface being constituted by the assemblage of connecting device (10)+discharge tube (1). Once more, it should be clarified that the sealing material used in the connection disclosed herein may comprise an adhesive which, however, operates with the function of a sealing element, and not as an element for gluing or sealing the pieces; therefore, various materials may be used, provided they meet said need. After the application of the sealing material, it is carried out the application of UV (ultraviolet) light or the like to promote the bleaching thereof and, thus, to conclude the assembly of the connection.

In short, the process of connection of refrigerant fluid discharge tubes (1) to cylinder caps (2) of hermetic compressors, a subject matter of the present invention, comprises, therefore, the following steps:

(200) performing the rolling at the end of the discharge tube (1). Said process, which must necessarily be prior to starting the assembly of the connection, leaves only the end of the discharge tube (1) conical to prevent subsequent formation of chip, while in the remainder of the length the diameter of the tube must be ensured on the entire surface with which the connecting device (10) will be in contact;

(210) pre-assembly step: coupling, by interference, of the discharge tube (1) to the connecting device (10), wherein in the preferred embodiment illustrated in the attached FIG. 3, the tube (1) forms a male-type coupling element for co-operating with a female-type connecting device (10);

(220) positioning of the pre-assembled assemblage of discharge tube (1)+connecting device (10) through the duct or channel (21) of the cylinder cap (2) until the discharge tube (1) reaches the stop (22) existing inside the cylinder cap. Said step must be carried out without interference between the connecting device (10) and the cylinder cap (2) for the time being—to this end, the connecting device (10) is drawn to a safe distance so as not to contact the cylinder cap (2) before the discharge tube (1) reaches the stop (22) of the cylinder cap (2);

(230) coupling the connecting device (10) to the channel (21) of the cylinder cap (2). To this end, the connecting device (10) is pressed by its perimetral flap (12) and with the aid of an additional apparatus, to the channel (21) having a substantially conical surface of the cylinder cap (2) in order to couple the discharge tube (1) and the cylinder cap (2) by interference;

(240) applying at least one layer of adhesive material (not shown) on the two interfaces: connecting device (10)+cylinder cap (2), and connecting device (10)+discharge tube (1);

(250) applying UV (ultraviolet) light, or the like, to promote bleaching of the adhesive/sealing material.

It should be clarified that the solution disclosed herein may be used for the coupling of discharge tubes (1) in cylinder caps (2), regardless of the angle or direction of the coupling.

Therefore, it is noted that the subject matter of the present invention provides an efficient, practical and economical solution for performing the coupling of discharge tubes (or others of the system) in cylinder caps of hermetic compressors for cooling systems.

The invention claimed is:

1. Improvement introduced in a system for connecting refrigerant fluid discharge tubes to cylinder caps of hermetic compressors, more precisely to promote coupling between at least one discharge tube in a cylinder cap of a compressor, comprising:

at least one connecting device comprising a tubular body provided, at one of its ends, with a perimetral flap co-operative with the discharge tube;

a cylinder cap comprising at least one channel co-operative with the at least one connecting device; and at least one layer of sealing material applied on interfaces of the at least one connecting device co-operative with the cylinder cap, and the at least one connecting device co-operative with the discharge tube;

wherein a free end of the discharge tube co-operating with the connecting device has conical form;

wherein the co-operation between the discharge tube and the connecting device is made by interference;

wherein the co-operation between the connecting device and the at least one channel of the cylinder cap is made by interference, the channel having a substantially conical inner surface;

wherein there is no contact between the discharge tube and the cylinder cap;

wherein an inner surface of the connecting device, which remains in contact with the discharge tube, is plain and rectilinear; and wherein the connecting device is produced with at least one of the following materials: steel, aluminum alloy, or metal alloy containing steel or aluminum.

2. Improvement, according to claim 1, characterized by the fact that the sealing material comprises an adhesive material.

3. Process of performing connection of refrigerant fluid discharge tubes to cylinder caps of hermetic compressors, characterized by the fact that it employs at least one connecting device, according to claim 1, and it comprises the following steps:

performing the rolling at the end of the discharge tube;

pre-assembly step: coupling, by interference, of the discharge tube to the connecting device;

positioning of the pre-assembled assemblage of discharge tube with connecting device through the channel of the cylinder cap until the discharge tube reaches the stop existing inside the cylinder cap;

coupling the connecting device to the channel of the cylinder cap by the pressure put by an apparatus adapted to the perimetral flap of the connecting device;

applying at least one layer of sealing material on the two interfaces: connecting device co-operative with the cylinder cap, and connecting device co-operative with the discharge tube;

applying ultraviolet light, or the like, to promote bleaching of the sealing material.

4. Process, according to claim 3, characterized by the fact that the tube forms a male-type coupling element for co-operating with a female-type connecting device.

* * * * *